US009375719B2

(12) United States Patent
Hambalkó et al.

(10) Patent No.: US 9,375,719 B2
(45) Date of Patent: Jun. 28, 2016

(54) LATERAL WALL FOR A ROLLER PRESS

(75) Inventors: Andor Hambalkó, Fürstenfeldbruck (DE); Meinhard Frangenberg, Kürten-Engeldorf (DE); René Van Der Ende, Hürth (DE)

(73) Assignee: KHD Humboldt Wedag GmbH, Cologne (DE)

( * ) Notice: Subject to any disclaimer, the term of this patent is extended or adjusted under 35 U.S.C. 154(b) by 889 days.

(21) Appl. No.: 13/503,811

(22) PCT Filed: Oct. 15, 2010

(86) PCT No.: PCT/EP2010/065550

§ 371 (c)(1),
(2), (4) Date: Apr. 24, 2012

(87) PCT Pub. No.: WO2011/051117

PCT Pub. Date: May 5, 2011

(65) Prior Publication Data

US 2012/0204617 A1 Aug. 16, 2012

(30) Foreign Application Priority Data

Oct. 29, 2009 (DE) ..... 20 2009 014 656 U

(51) Int. Cl.
*B02C 4/28* (2006.01)
*B02C 4/02* (2006.01)

(52) U.S. Cl.
CPC .. *B02C 4/283* (2013.01); *B02C 4/02* (2013.01)

(58) Field of Classification Search
CPC ..... B02C 4/283; B02C 4/02
USPC ..... 72/237, 246; 241/226; 100/155 R, 175, 100/176, 156, 157, 158 R, 158 C, 159, 160, 100/161, 162 R, 163 R, 164, 165, 163 A, 100/166, 162 B, 167, 168, 169, 170, 171, 100/172, 173, 174
See application file for complete search history.

(56) References Cited

U.S. PATENT DOCUMENTS

| | | | | | |
|---|---|---|---|---|---|
| 3,332,630 | A | * | 7/1967 | Verdier | 241/159 |
| 3,361,059 | A | * | 1/1968 | Klingler | 101/169 |
| 3,529,462 | A | * | 9/1970 | Tracy | 72/237 |
| 3,985,488 | A | * | 10/1976 | Hoffmann | 425/363 |
| 4,716,435 | A | * | 12/1987 | Wilson | 399/332 |
| 4,716,826 | A | * | 1/1988 | Gibellino et al. | 101/169 |
| 4,838,494 | A | * | 6/1989 | Jakobs | 241/226 |
| 5,241,903 | A | * | 9/1993 | Lampic | 100/349 |
| 5,435,239 | A | * | 7/1995 | Talbot | 99/618 |

FOREIGN PATENT DOCUMENTS

| | | |
|---|---|---|
| DE | 564024 | * 10/1932 |
| DE | 564024 | 11/1932 |
| DE | 100 12 696 | 9/2001 |

* cited by examiner

*Primary Examiner* — David Bryant
*Assistant Examiner* — Lawrence Averick
(74) *Attorney, Agent, or Firm* — Greer, Burns & Crain Ltd.

(57) ABSTRACT

A lateral wall arrangement for laterally bounding the roller gap of a roller press having rollers supported in a machine frame, driven in opposite directions, and forming a roller gap, comprising a lateral wall, an assembly device, and a suspension for the lateral wall, wherein the lateral wall is supported in a spring-loaded manner by the suspension. The suspension is a linkage in the simplest case. It is thus achieved in an advantageous manner that the lateral wall is both easy to dismantle and is able to follow deflection motions of the rollers.

14 Claims, 2 Drawing Sheets

LATERAL WALL FOR A ROLLER PRESS

BACKGROUND OF THE INVENTION

The invention relates to a lateral wall arrangement for laterally bounding the roller gap of a roller press having rolls supported in a machine frame, driven in opposite directions and forming a roller gap, comprising a lateral wall, an assembly device and a suspension for the lateral wall, wherein the lateral wall is supported in a spring-loaded manner by the suspension.

In roller presses for the high-pressure comminution of material to be ground, the material to be comminuted is discharged uniformly onto the roller gap of two rolls rotating in opposite directions, the material to be ground being drawn into the roller gap by the rolls and compacted there. If the compaction is very high, the material structure of the material to be comminuted fractures and forms briquette-like flakes, which leave the roller gap on the side opposite the feed side. These flakes can then be de-agglomerated with the comparatively low expenditure of energy, by which means a comminuted material to be ground can be obtained. As mentioned at the beginning, it is important for the high-pressure comminution to charge the roller gap uniformly with material to be ground, in order that the roller press does not operate as a breaker and therefore exhibit a lower comminution performance. In order to charge the roller gap uniformly with material to be ground, the material is distributed uniformly over the length of the roller gap by a discharge device. It is necessary to devise a boundary in each case at the ends of the rolls in order that the material to be ground does not fall out of the roller press at these points and this thus leads to a non-uniform discharge of material over the length of the roller gap. Such a boundary can in the simplest case be a lateral wall in each case, which each bear closely on the rotating ends of the rolls in the roller press.

However, if one or both rolls of the roller press is movable as a loose roll, in order to be able to carry out deflection movements in the event of a non-uniform discharge of material to be ground, the lateral walls must be able to follow this mobility. Furthermore, the lateral walls interfere during the regular maintenance and the cyclic changing of the rolls, which are stressed highly by wear, since the lateral walls firstly have to be dismantled and each individual dismantling step during a roll change leads to an undesired prolongation of the stoppage time.

German Laid-open Specification DE 3705051 A1 discloses a roller press in which the lateral walls are fixed by a link to the lateral walls of the material discharge device located above the latter and are supported against the ends of the rolls by an outrigger via compression springs received in clamping screws. Because of the compression springs, the lateral walls suspended on the link are capable of following deflection movements of the rolls. This type of suspension has proven worthwhile in operation but is complicated to dismantle during the regular roll change.

In German Patent DE 102007032177 B3, a lateral wall for a roller press is disclosed which is received in a slotted guide. The slotted guide permits the lateral wall to carry out a movement during the dismantling of the rolls in which the lateral wall is moved away from the end of a roll. Between the lateral wall and the slotted guide, a lever connected to the lateral wall in the manner of a rotary joint ensures that the lateral wall is locked in its operating position. However, this locking prevents the lateral wall from deflecting during operation, which means that the lateral wall can be damaged and in the extreme case can be destroyed.

SUMMARY OF THE INVENTION

The invention is therefore based on the object of providing a lateral wall arrangement for a roller press mentioned at the beginning which is both simple to dismantle and is also capable of following deflection movements of the rolls.

According to the invention, a link is proposed as a suspension for the lateral wall in the simplest case, the link being received in an assembly device. In order to dismantle it, the entire lateral wall arrangement is separated from the machine frame of the roller press, in that the assembly device which carries the entire lateral wall arrangement is detached from the machine frame. Unlike the aforementioned prior art, the lateral wall arrangement forms a module of a roller press, this module permitting the spring-loaded suspension of a lateral wall.

BRIEF DESCRIPTION OF THE DRAWINGS

The invention and further features and advantages thereof will be explained in more detail by using the exemplary embodiments illustrated schematically in the figures, in which.

DETAILED DESCRIPTION OF THE PREFERRED EMBODIMENTS

Figure 1:
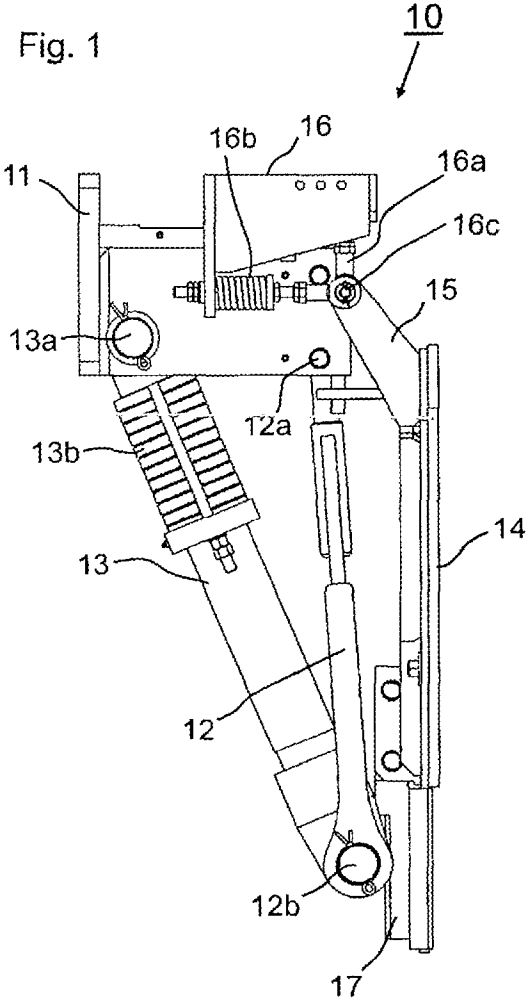
FIG. 1 shows the lateral wall arrangement according to the invention in a side view.

FIG. 1 shows a lateral wall arrangement 10 according to the invention in a side view, in which the three important constituent parts, namely the assembly device 11, link 12 and lateral wall 14, can be seen clearly. In the embodiment of the invention illustrated in concrete terms here, the suspension comprises a three-joint lever mechanism having two levers coupled to each other in the manner of a rotary joint via a common joint 12*b*, link 12 and spring leg 13 and having different axes of rotation 12*a*, 13*a*, a first lever, link 12, having an adjustable length and a second lever comprising a spring leg 13.

In this side view, the lateral wall 14 can be seen only by way of a narrow profile, the lateral wall 14 being mounted in the manner of a rotary joint via a lug 15 in a bearing device 16 with rotary bearing 16*c*. The bearing device 16 is in turn fixed to the assembly device 11 and has two bearing receivers 16*a* and 16*b* for a rotary bearing 16*c*, via which the rotary bearing 16*c* located in the bearing receivers 16*a* and 16*b* can move slightly with two degrees of freedom for the purpose of fine adjustment. Apart from the three constituent parts comprising assembly device 11, link 12 and lateral wall 14, a compression rod in the form of a spring leg 13 is also provided, through which the lateral wall 14 experiences a pressing force of about 20,000 N to the right in this view, the spring leg 13 optionally also having a damping system. The aforementioned pressing force is generated in spring leg 13 by a preloaded spring 13*b*, wherein the spring 13*b* can comprise a spiral spring or else a disk spring pack. In operation, the preloaded spring 13*b* stresses the spring leg 13, so that the latter experiences a lengthening force but the preloaded spring 13*b* is provided with a stop, so that the spring leg 13 has reached the maximum length in this view. If a roll, located on the right of the lateral wall 14 in this view and not shown here, carries out a deflection movement and, in the process, swings out slightly to the left, the lateral wall 14 is forced to the left. Link 12 follows this movement by means of a rotational movement of a few degrees oriented in a clockwise direction. During this rotational movement in a joint or a rotary bearing about the axis of rotation 12*a*, the spring leg 13 is compressed counter to the force of the preloaded spring 13*b* with an axis of rotation 13*a* offset to the left with respect to axis of rotation 12*a*, and as a result of this compression, the link 12 experiences a tensile force, for which reason this link 12 can also be designated a tie rod. As a result of this concerted movement of link 12 and spring leg 13, the lateral wall 14 deflects to the left, the lateral wall 14 moving by a short distance in a linear bearing 17 suspended in the manner of a rotary joint, in the simplest case a dovetail slide. As compared with the link 12 and the spring leg 13, the lateral wall 14 has a third axis in rotary bearing 16*c*, the position of which is determined by the finely adjusted position of the bearing receivers 16*a* and 16*b*.

When installed in a roller press, the lateral wall arrangement 10 is fixed to a machine frame of the roller press via the assembly device 11 at the top left in FIG. 1. For the purpose of dismantling, it is sufficient for the assembly device 11 to be detached from the machine frame, it being possible for the entire lateral wall arrangement 10 to be removed from the machine frame, not shown here. If appropriate, before dismantling the lateral wall 10 from a roller press, it is necessary to displace the bearing device 16, fixed to the assembly device 11 in slots, in the direction of the machine frame and to lengthen the link 12 by means of a corresponding length adjustment, which is explained in more detail below. As a result, the lateral wall 14 is displaced in a parallel manner to the left in FIG. 1 and removed from a roll not illustrated in FIG. 1 but adjoining on the right, and also from a lateral wall of a discharge device for material to be ground arranged above the lateral wall 14.

After the lateral wall arrangement 10 has been reassembled following a roll change, the alignment of lateral wall 14 can be adjusted finely by adjusting on the bearing receiver 16*a* such that the lateral wall 14 has a vertical alignment. In order to adjust the lateral wall 14 in its horizontal position, provision is made to lengthen or to shorten the link 12 by means of a length adjustment, in the simplest case by rotating a double nut with left-hand and right-hand internal thread on a link part in each case having a left-hand and right-hand external thread, by which means the position of the connection between link 12 and spring leg 13 by the joint 12*b* can be changed not only in the vertical position but also in the horizontal position. The change in the length of the link 12 does not change the vertical position of the lateral wall 14, since it is accommodated in a linear bearing 17 suspended in the manner of a rotary joint but, during the change to the length of the link 12, the horizontal position of the latter is displaced, since the connection between link 12 and spring leg 13 by means of joint 12*b* takes the horizontal position of the lateral wall 14 with it as a result of an approximately rotational movement in the clockwise direction. In order to align the lateral wall 14 finely in the vertical position, provision is made to adjust the latter by means of an adjustment of the bearing receiver 16*b*.

Figure 2:
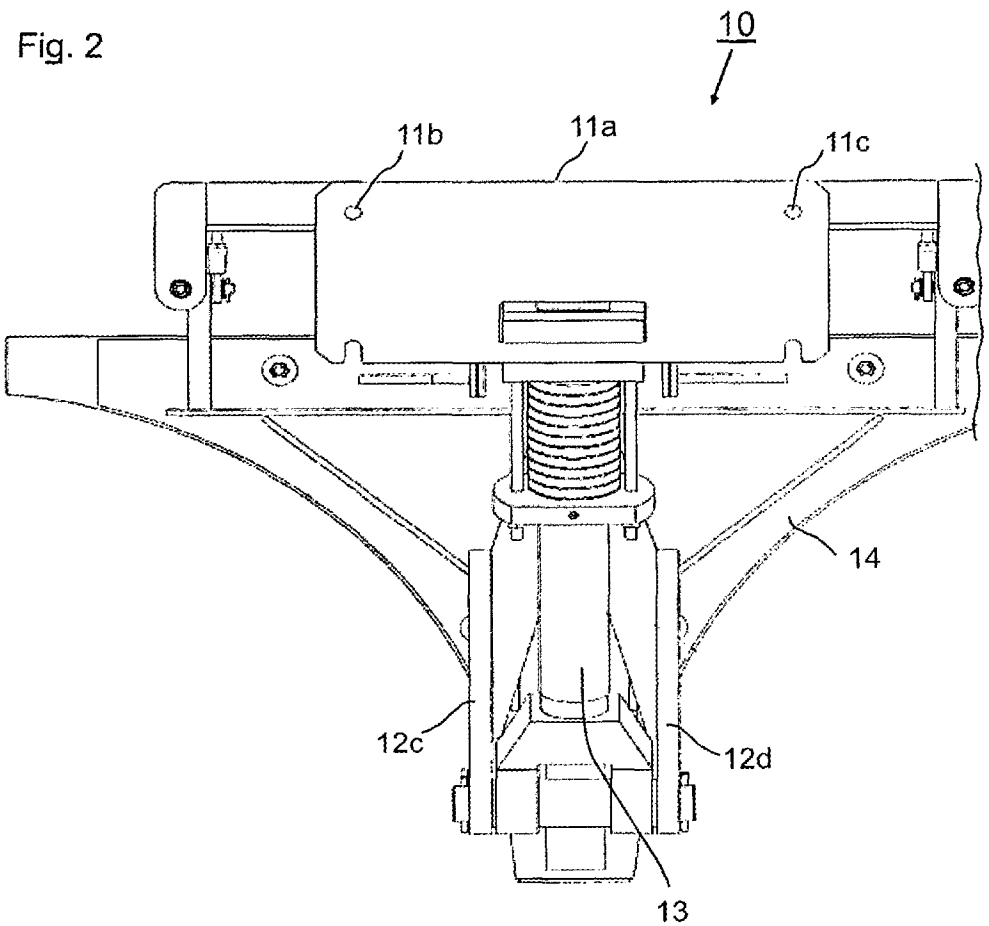
FIG. 2 shows the lateral wall arrangement according to FIG. 1 in a rear view.

FIG. 2 shows the lateral wall arrangement 10 according to FIG. 1 in a rear view. To be seen clearly is a flange 11*a*, which is part of the assembly device 11 and via which the entire lateral wall arrangement 10 is fixed to the machine frame of a roller press with the aid of the drilled holes 11*b* and 11*c*.

In this view, it is also possible to see that the link 12 has two limbs 12*c* and 12*d*, which enclose the spring leg 13 symmetrically from two sides. In the background, it is finally possible to see the lateral wall 14, which has the shape of a triangle standing on its point, with two concave sides and a rectilinear base located at the top.

Figure 3:
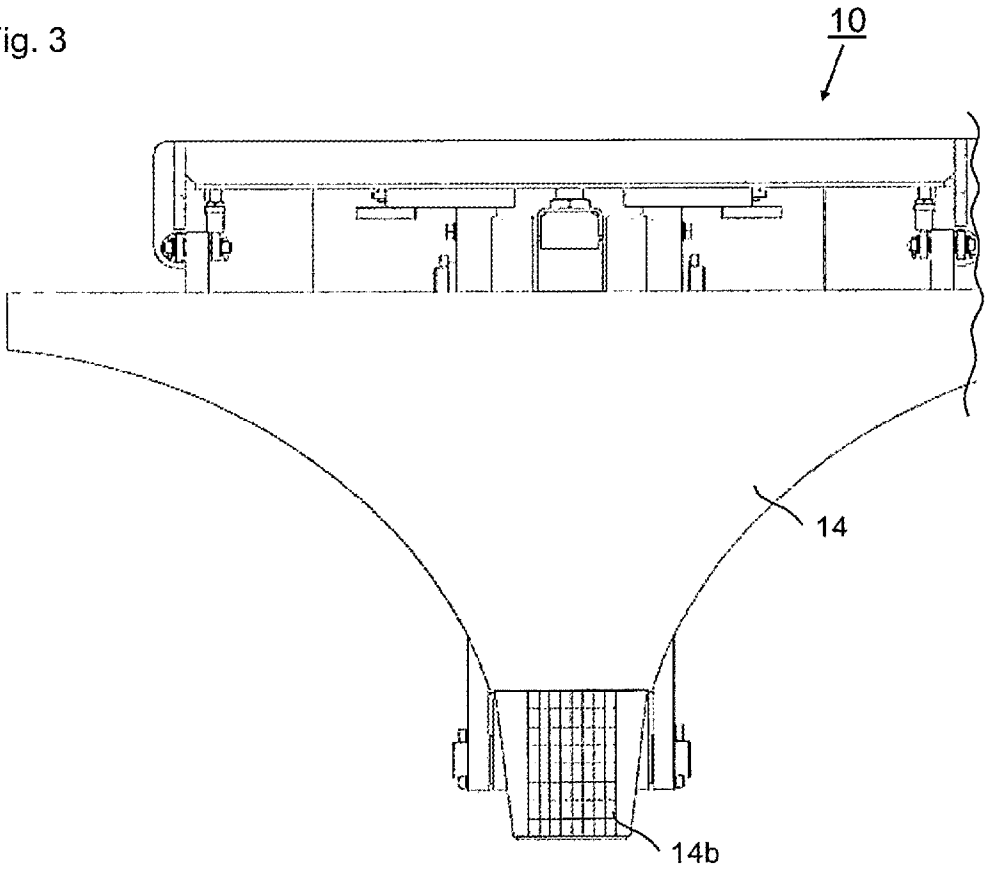
FIG. 3 shows the lateral wall arrangement according to FIG. 1 in a front view.

FIG. 3, finally, shows the lateral wall arrangement according to FIG. 1 in a front view, which is dominated by the shape of the lateral wall 14. It can be seen in this case that, at the lower point, where the lateral wall 14 comes into contact with the compaction zone of the roller gap, the lateral wall 14 is equipped with an anti-wear layer 14*b*, since at this point the abrasive forces of the material to be ground which is drawn through the roller gap act most intensely.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF DESIGNATIONS

| | |
|---|---|
| 10 | Lateral wall arrangement |
| 11 | Assembly device |
| 11a | Flange |
| 11b | Drilled hole |
| 11c | Drilled hole |
| 12 | Link |
| 12a | Axis of rotation |
| 12b | Joint |
| 12c | Limb |
| 12d | Limb |
| 13 | Spring leg |
| 13a | Axis of rotation |
| 13b | Spring |
| 14 | Lateral wall |
| 14b | Anti-wear layer |
| 15 | Lug |
| 16 | Bearing device |
| 16a | Bearing receiver |
| 16b | Bearing receiver |
| 16c | Rotary bearing |
| 17 | Linear bearing |

The invention claimed is:

1. A lateral wall arrangement for laterally bounding the roller gap of a roller press having rolls supported in a machine frame, driven in opposite directions and forming a roller gap, comprising:

an assembly device, a lateral wall, and a suspension in the form of a link for the lateral wall, the link comprising a three joint lever mechanism of two levers coupled to each other by a common rotary joint defined by a first axis of rotation, with the first of the two levers being rotationally coupled to the assembly device at a second axis of rotation and the second of the two levers being rotationally coupled to the assembly device at a third axis of rotation, the second and third axes of rotation being different from each other and each being different from the first axis of rotation of the common joint, and wherein a first of the two levers has an adjustable length and a second of the two levers comprises a spring leg, wherein the lateral wall is supported in a spring-loaded manner by the suspension.

2. The lateral wall arrangement as claimed in claim 1, wherein the spring leg has a damping system.

3. The lateral wall arrangement as claimed in claim 1, wherein the first lever is connected in the manner of a rotary joint to the spring leg by two limbs, and wherein the two limbs enclose the spring leg symmetrically from two sides.

4. The lateral wall arrangement as claimed in claim 1, wherein the lateral wall has a connection to the link at a first point and, at a second point, is suspended with respect to the assembly device in a rotary bearing.

5. The lateral wall arrangement as claimed in claim 4, wherein the rotary bearing is suspended resiliently in two degrees of freedom.

6. The lateral wall arrangement as claimed in claim 4, wherein the connection is a linear bearing suspended in the manner of a rotary joint.

7. The lateral wall arrangement as claimed in claim 1, wherein the lateral wall has an anti-wear layer on a side facing the roller gap.

8. A lateral wall arrangement for laterally bounding the roller gap of a roller press having rolls supported in a machine frame, driven in opposite directions and forming a roller gap, comprising:

an assembly device configured to be securable to the machine frame, a lateral wall and a suspension in the form of a link for the lateral wall, the link comprising a three-joint lever mechanism comprised of two levers coupled to each other at their first ends by a common rotary joint having a first axis of rotation and a second end of the first of the two levers being rotationally joined to the assembly device with a second axis of rotation and a second end of the second of the two levers being rotationally joined to the assembly device with a third axis of rotation, the first, second and third axes of rotation being different from each other, and wherein a first of the two levers has an adjustable length and a second of the two levers comprises a spring leg, wherein the lateral wall is supported on the assembly device in a spring-loaded manner by the suspension.

9. The lateral wall arrangement as claimed in claim 8, wherein the spring leg comprises a damping system.

10. The lateral wall arrangement as claimed in claim 8, wherein the first lever is connected at the rotary joint to the spring leg by two limbs, and wherein the two limbs symmetrically enclose the spring leg on two sides.

11. The lateral wall arrangement as claimed in claim 8, wherein the lateral wall has a connection to the link at a first point and, at a second point, is suspended with respect to the assembly device in a rotary bearing.

12. The lateral wall arrangement as claimed in claim 11, wherein the rotary bearing is suspended resiliently in two degrees of freedom.

13. The lateral wall arrangement as claimed in claim 11, wherein the connection is a linear bearing suspended in the manner of a rotary joint.

14. The lateral wall arrangement as claimed in claim 8, wherein the lateral wall has an anti-wear layer on a side facing the roller gap.

* * * * *